United States Patent [19]

Joshi

[11] Patent Number: 5,013,486

[45] Date of Patent: May 7, 1991

[54] DETERGENT BAR WITH IMPROVED STAIN REMOVING AND ANTIBACTERIAL PROPERTIES

[75] Inventor: David Joshi, So. Plainfield, N.J.

[73] Assignee: Colgate-Palmolive Company, Piscataway, N.J.

[21] Appl. No.: 344,410

[22] Filed: Apr. 28, 1989

[51] Int. Cl.[5] ..... C11D 1/14; C11D 1/22; C11D 3/48

[52] U.S. Cl. ..... 252/559; 252/106; 252/176.25; 252/558; 252/DIG. 16

[58] Field of Search ..... 252/106, 108, 132, 558, 252/DIG. 16

[56] References Cited

U.S. PATENT DOCUMENTS

| | | | |
|---|---|---|---|
| 3,240,711 | 3/1966 | Wittwer . | |
| 3,490,743 | 1/1970 | Schmitz et al. . | |
| 3,703,472 | 11/1972 | Shaw et al. . | |
| 3,812,046 | 5/1974 | Lancz . | |
| 4,515,707 | 5/1985 | Brooks | 252/531 |
| 4,543,204 | 9/1985 | Gervasio | 252/529 |
| 4,561,991 | 12/1985 | Herbots | 252/DIG. 14 |
| 4,597,887 | 7/1986 | Colodney et al. . | |
| 4,711,739 | 12/1987 | Kandathil | 252/DIG. 12 |
| 4,769,172 | 9/1988 | Siklosi | 252/DIG. 11 |

FOREIGN PATENT DOCUMENTS 2189255 10/1987 United Kingdom .

OTHER PUBLICATIONS

Davidsohn, *Soap Manufacture,* Interscience Publishers, New York, p. 501.

Schwartz and Perry, *Surface Active Agents: Their Chemistry and Technology,* Interscience Publishers, p. 233.

Gregory, *Uses and Applications of Chemicals and Related Materials,* Reinhold Publishing, 1939, pp. 470–471.

*Primary Examiner*—Paul Lieberman

*Assistant Examiner*—Alexander G. Ghyka

*Attorney, Agent, or Firm*—Richard J. Ancel; Robert C. Sullivan; Murray M. Grill

[57] ABSTRACT

A detergent bar of good mildness and foaming properties for hand washing laundry containing pine oil or pine oil derivatives as stain removal and antibacterial agents.

2 Claims, No Drawings

DETERGENT BAR WITH IMPROVED STAIN REMOVING AND ANTIBACTERIAL PROPERTIES

FIELD OF THE INVENTION

The invention relates to a stable synthetic detergent bar of good mildness and foaming properties comprising a detergency builder, a filler material, a surface active agent and pine oil or pine oil derivatives as a stain remover and an antibacterial agent.

The invention further relates to an efficient synthetic laundry detergent bar composition and its method of preparation. The particular sequence and the point of addition of the builder-filler material affects the quality of the laundry bar and the addition of the pine oil effects the stain removal and antibacterial as well as fragrance properties of the product.

SUMMARY OF THE INVENTION

The object of the invention is to provide a synthetic laundry bar having excellent detergency, slow "use-up" rate, smooth texture, physical hardness and enhanced stain removal and antibacterial properties.

Another object of the invention is to provide a synthetic detergent bar comprising pine oil or pine oil derivatives as a stain remover and to improve the antibacterial properties of the detergent bar.

A further object of the invention to provide a unique manufacturing procedure which produces a synthetic laundry bar with excellent physical hardness, texture, stain removal and antibacterial properties.

BACKGROUND OF THE INVENTION

Soap bars have been used to wash the human body and for "doing laundry" for some time. Before the advent of the washing machine which dictated the employment of materials as powder, disintergratable brickets or liquid forms; laundry was washed with laundry soap bars made from suitable soaps of higher fatty acids such as sodium soaps of mixed tallow and rosin fatty acids. Laundry soap bars were especially suitable for being rubbed on the badly stained soiled portion of fabrics being laundered, as on a wash board, to deposit a high concentration of the soap on the soiled area.

Despite the fact that after introduction of synthetic or organic detergents and washing machines the amount of soap employed for laundry use diminished greatly, with soap based laundry bar being replaced mostly by synthetic or organic detergent compositions in powder, liquid or other suitable form, laundry soaps and detergents in bar form are still preferred by some customers especially in certain areas of the world. Several detergent laundry bars based on alkyl benzene sulfonate detergents have been successfully marketed. They have been characterized as the equivalence in detersive action of powdered laundry detergent based on alkyl benzene sulfonates and are considered by many consumers to be more convenient to use.

Although several detergent compositions for use of high surface area cleanser products contain pine oil, the use of pine oil and its derivatives in a laundry detergent bar has not been known.

Surprisingly it had been discovered that it is possible to make a synthetic detergent cleansing article having improved stain removal and antibacterial properties which has overall excellent cleansing performance and physical characteristics, by incorporating pine oil or pine oil derivatives into the composition. It has been discovered that the order in which the pine oil is incorporated into the composition is very important to produce a synthetic detergent bar having suitable hardness, texture and improved stain removing and antibacterial properties.

The use of the mixture of pine oil and ammonia in detergent composition is disclosed in U.S. Pat. No. 3,703,472. U.S. Pat. No. 4,705,644 discloses detergent laundry bars that are mild to the hands of the user have good foaming properties in hand washing and good processing characteristics U.S. Pat. No. 4,219,535 discloses the use of zeolite A as a detergent builder. U.S. Pat. No. 4,543,204 discloses synthetic detergent cleansing articles based on sodium fatty alcohol sulfate. The patent also discloses the use of builders that may be used to replace phosphate.

DETAILED DESCRIPTION OF THE INVENTION

To achieve the foregoing and other objects according to the present invention as embodied and broadly described herein the synthetic detergent bar of this invention comprises about 0-50% of an anionic surfactant, 5-50% of a selected builder or mixtures thereof, 20-40% of a bodying agent and 0.5-5% of pine oil or derivative thereof, to impart antibacterial and improve stain removing properties to the laundry bar.

Suitable surface active agent may include alkyl aryl sulfate fatty alcohol sulfates, ethoxylated fatty alcohol sulfates, methyl esters, and mixtures thereof.

Preferable surface active compositions include and more definitely, sulfonated $C_7$-$C_{18}$ alkyl benzene sulfonates and $C_4$-$C_{18}$ fatty alcohol sulfates. Suitable alkyl sulfonates include alkyl benzene sulfonates including those in which the alkyl group is of straight chain configuration and contains from about nine to about 18 carbon atoms. Some of the more readily available compounds include the following: sodium decyl benzene sulfonate, sodium dodecyl benzene sulfonate, sodium tridecyl benzene sulfonate, and sodium hexadecyl benzene sulfonate. Preferably, the alkyl benzene sulfonate has an alkyl side chain and is in the form of a liquid of 96% by weight minimum purity. The content of alkyl aryl sulfonate will be in the range of 0 to 50%, preferably 5-35%, most preferably 20-30% by weight of the laundry bar composition. When the alkylaryl sulfonate is mixed with an additional surface active agent it is preferably 10-85% of the surface active composition.

The most useful sulfated alcohols are derived from higher alkyl fatty alcohols having nine to 18 carbon atoms. Highly desirable detergency is obtained from the hydrophobic carbon chain length of the alkyl sulfate containing 12 to 18 carbon atoms. Highly preferred for use in this invention is sodium coco fatty alcohol sulfate typically having a white cream to heavy paste consistency and a minimum purity of 60% by weight. The content of fatty alcohol will be in the range of 0 to 50%, preferably 5-35%, most preferably 5-20% by weight of the laundry bar composition. Preferably the fatty alcohol sulfate constitutes 15-70% by weight of the surface active agents of detergent bar. Also included among possible surfactants are higher fatty alcohol ethoxylate sulfates. Furthermore, the ethoxy sulfate is preferably derived from a fatty alcohol which is essentially saturated and of a carbon atom chain length within the 10 to 18 carbon atoms range, often more preferably of 12 to 16 or 12 to 15 carbon atoms. The ethoxy chain of the sulfate being of 3 to 8 ethoxy groups, and more preferably it is of about 3 ethoxy group(s). The range of this ingredient is 0–50% by weight.

The alpha-sulpho methyl esters most preferred for use in this synthetic detergent bar are derived from coconut oil, with a coco-methyl ester having less than 22% by weight of the alkyl group having a chain length of $C_{10}$ or less, and having less than 2% by weight iodine value. The content of alpha-sulfo methyl ester will be 0–50%, preferably 5–35% by weight of the laundry bar composition.

In addition to the surface active ingredient, the synthetic detergent bar comprises zeolite and builder/filler material. The preferred zeolite for use in the synthetic detergent bar composition is zeolite A and preferably zeolite 4A.

Various water soluble builder salts, usually as sodium salts, may be incorporated in the invented laundry bars. Of these the most important are the phosphates, particularly the polyphosphates, such as sodium tripolyphosphate and sodium pyrophosphate. Sodium orthophosphate may be employed, usually in minor proportion with respect to the polyphosphate(s). Other builder salts, of the chelating or precipitating types, inorganic and organic may also be used, such as sodium carbonate, sodium silicate, normally of $Na_2O:SiO_2$ ratio in the range of 1:1.6 to 1:3, preferably 1:2 to 1:3, and more preferably 1:2 to 1:2.4, borax, and sodium bicarbonate. Other builders, including organic builders, such as trisodium nitrilotriacetate (NTA), sodium polyacrylate, sodium citrate and sodium polyacetal carboxylate may be used, as may be other water soluble salts of the corresponding acids.

Preferably the laundry detergent bar contains 5–50%, preferably 5–15%, most preferably 9.6% tetrasodium pyrophosphate builder.

Suitable filler material has a particle size of less than 75 micron, thus being capable of passing through a 200 mesh U.S. Series Sieve.

Addition filler material of similar particle size may include calcium carbonate, soda ash, magnesium sulfate magnesium carbonate and a mixture thereof also, talc, sodium sulfate, clay and starch. The total filler content is typically up to about 60%, preferably 20–40%, of the synthetic detergent bar composition. Magnesium sulfate is preferred as it adds to detergent cleansing bars hardness.

The essential feature of the invention resides in the addition of 0.5 to 5% by weight of pine oil or pine oil derivatives to improve the stain removal and antibacterial properties of the detergent bar. The builder, filler and surface active agents and other components may be admixed with other ingredients such as dyes, pigments, perfume, opacifier and whitening agents, brighteners, bleaching agents, antioxidants, bactericides, fungicide, anti-redeposition agents for example carboxymethyl cellulose and other polymers.

It has been discovered that hardness and texture qualities as well as stain removing properties of the detergent bar can be greatly enhanced by using a particular processing method. This method comprises pre-addition of builder to the acidic surfactant/filler phase prior to neutralization of the acidic phase with soda ash. Pine oil is added after neutralization with soda ash is completed during the amalgamation step in the bar making process.

The pine component employed in the detergent compositions of the invention is a commercially obtainable terpene rich oil such as is produced during wood carbonization by dry distillation of pine tree wood or by extraction from chips or resinous tree stumps. Terpineol is generally the most abundant single constitutent, but substantial amounts of borneol, fenchyl alcohol, and terpenes are also usually present as well as minor amounts of hydrocarbons, ethers, esters, ketones and phenols. As employed throughout this application and in the appended claims, therefore, the term "pine oil" should be understood as referring to and is intended to refer to a terpene rich oil as described above.

In addition to the aforementioned benefits it has been discovered that the use of pine oil in a detergent laundry bar imparts improved softness to fabrics. The results of a softness test on terrycloth washed with a detergent laundry bar with and without pine oil are given in Table I.

TABLE I

| | *Average ratings of 10 panelists |
|---|---|
| detergent bar without pine oil | 3.6 |
| detergent bar with pine oil | 5.4 |

*The softness rating scale is 0–10 with 10 being the softest. A difference of over 1 unit is a significant improvement.

The synthetic detergent cleansing article is typically prepared by mixing the ingredients following the aforementioned builder pre-addition order of addition in an amalgamator mixer of counter-rotating sigma blades. The mixer should be equipped with a chilling temperature of 10°–15° C. The batch is subsequently plodded under vacuum and extruded as a homogeneous bar. The bars are then rolled and pressed into shape. Alternatively, the bars may be cut and imprinted after cooling. In addition various other functional ingredients some of which may improve the synthetic detergent bar's mildness to the skin may be incorporated into the detergent bar as desired. Examples are cocodiethanolamide, glycerin, lanolin and other moisturizers.

Silicate may be added after neutralizaton as a binder and plasticizer. Any water-soluble silicate can be used, preferably a sodium silicate having a 1:2.4 $Na_2O:SiO_2$ ratio. The weight range for this ingredient is 0 to 3.0%.

ILLUSTRATIVE EXAMPLES OF THE INVENTION

The following examples are given to further illustrate the invention the proportions and amounts are by weight.

EXAMPLE 1

Typical laundry bar pine oil formulation.

| | |
|---|---|
| Alkyl benzene sulfonic acid | 25.5 |
| Gantrez Polyacrylate Solution (20% solution) | 0.5 |
| Tap Water | 0.3 |
| Magnesium Sulfate 25% Solution | 2.9 |
| Tetra Sodium Pyro Phosphate | 9.6 |
| Zeolite | 2.4 |
| Sodium Carbonate | 14.4 |
| Coco Fatty Alcohol Sulfate Paste (75% AI) | 9.2 |
| Calcium Carbonate | 17.3 |
| (Minors) Brighteners, Colors, etc | 0.8 |
| Pine Oil | 1.5 |
| Calcium Carbonate | (15.6) Q.S. |
| | 100.0 |

This is a typical laundry bar formulation. The formulation may be varied by varying the types of surfactants builders and fillers. A higher level of coco fatty alcohol sulfate may be used and tetrasodium pyro phosphate may be replaced with tri polyphosphate. Additional ingredients such as bentonite may be added.

EXAMPLE 2

The detergency tests where completed using the detergent formulation of example 1. In this test six variously stained fabrics including grape juice stains on spun nylon and liquid make-up stains on cotton percale were evaluated with the formulation shown above and with the same formulation without the pine oil. The formulation with the pine oil had a much better stain removal properties. The use of pinene improved the stain removal on grass stains and red Crisco shortening stains.

EXAMPLE 3

This example illustrates the antibacterial properties of this formulations of the instant invention. In this series of runs the amount of pine oil present in the formulation as set out in Example 1 was varied 0.5% to 5%. *E. coli* was used in each of tests and the contact time was 10 minutes.

The data collected is set out in the table below.

TABLE II

| | BACTERIAL COUNT | | | |
|---|---|---|---|---|
| SAMPLE NO.: | *CFU/ML | LOG 10 | LOG REDUCTION | % REDUCTION |
| 0.5% DETERGENT SOLUTION | | | | |
| Water | $3.2 \times 10^7$ | 7.51 | — | — |
| 6510A 0% Pine Oil | $4.1 \times 10^6$ | 6.61 | 0.91 | <90.0 |

TABLE II-continued

| | BACTERIAL COUNT | | | |
|---|---|---|---|---|
| SAMPLE NO.: | *CFU/ML | LOG 10 | LOG REDUCTION | % REDUCTION |
| 6511A 0.5% Pine Oil | $2.4 \times 10^6$ | 6.38 | 1.14 | 90.0 |
| 6512A 1.5% Pine Oil | $3.8 \times 10^5$ | 5.58 | 1.94 | 99.0 |
| 6514A 5% Pine Oil | $3.6 \times 10^5$ | 5.56 | 1.96 | >99.0 |
| Water | $3.4 \times 10^7$ | 7.53 | — | — |
| 1% DETERGENT SOLUTION | | | | |
| Water | $3.4 \times 10^7$ | 7.53 | — | — |
| 6510B 0% Pine Oil | $8.0 \times 10^6$ | 6.90 | 0.63 | 0 |
| 6511B 0.5% Pine Oil | $3.8 \times 10^6$ | 6.58 | 0.95 | 90.000 |
| 6512B 1.5% Pine Oil | $3.0 \times 10^3$ | 3.48 | 4.05 | 99.990 |
| 6513B 2% Pine Oil | $5.4 \times 10^4$ | 4.73 | 2.80 | 99.000 |
| 6514B 5% Pine Oil | $4.0 \times 10^2$ | 2.60 | 4.93 | 99.999 |
| Water | $3.4 \times 10^7$ | 7.53 | — | — |

*Colony forming units

It is apparent from the data that as little as 0.5% pine oil reduces the bacterial count greater than 90% at 1.5% pine oil to 5% pine oil the % reduction is greater than 99%.

Obviously many modifications and variations of the invention made without departing from the essence scope thereof only such limitations should be applied as indicated in the appending claims.

What is claimed is:

1. A detergent bar which has good hardness, mildness and foaming characteristics consisting essentially of 5 to 35 percent alkyl benzene sulfates having 9 to 18 carbon atoms, 5 to 35 percent higher fatty alcohol sulfate, about 2.4 percent zeolite, about 2.9 percent of a 25 percent solution of magnesium sulfate and 0.5 to 5 percent pine oil.

2. A detergent bar according to claim 1 wherein the zeolite is zeolite A and the formulation also contains sodium silicate, borax and sodium bicarbonate as well as organic builder compounds.

* * * * *